US009901933B2

(12) United States Patent
Guerry et al.

(10) Patent No.: US 9,901,933 B2
(45) Date of Patent: Feb. 27, 2018

(54) DEVICE FOR SEPARATING OIL DROPS IN A MIXTURE OF GAS AND OIL AND A SEPARATION METHOD IMPLEMENTING SUCH A SEPARATOR DEVICE

(71) Applicant: MGI COUTIER, Champfromier (FR)

(72) Inventors: Pascal Guerry, Seppois-le-Haut (FR); Ludovic Serrurier, Nantua (FR); Adrien Eustache, Port (FR)

(73) Assignee: MGI COUTIER, Champfromier (FR)

( * ) Notice: Subject to any disclaimer, the term of this patent is extended or adjusted under 35 U.S.C. 154(b) by 13 days.

(21) Appl. No.: 14/872,677

(22) Filed: Oct. 1, 2015

(65) Prior Publication Data

US 2016/0096183 A1 Apr. 7, 2016

(30) Foreign Application Priority Data

Oct. 1, 2014 (FR) ..... 14 59387

(51) Int. Cl.

| | |
|---|---|
| ***B03C 3/04*** | (2006.01) |
| ***B03C 3/47*** | (2006.01) |
| ***B03C 3/41*** | (2006.01) |
| ***B03C 3/08*** | (2006.01) |
| ***B03C 3/12*** | (2006.01) |

(Continued)

(52) U.S. Cl.

CPC ..... *B03C 3/47* (2013.01); *B03C 3/08* (2013.01); *B03C 3/12* (2013.01); *B03C 3/14* (2013.01); *B03C 3/365* (2013.01); *B03C 3/41* (2013.01); *B03C 3/74* (2013.01); *B03C 3/88* (2013.01); *F01M 13/04* (2013.01); *B03C 2201/08* (2013.01); *B03C 2201/30* (2013.01); *F01M 13/0416* (2013.01); *F01M 2013/0466* (2013.01)

(58) Field of Classification Search

CPC combination set(s) only.
See application file for complete search history.

(56) References Cited

U.S. PATENT DOCUMENTS 4,269,607 A * 5/1981 Walker ..... B01D 45/00 123/573
4,718,923 A * 1/1988 Haag ..... B03C 3/019 55/DIG. 38

(Continued)

FOREIGN PATENT DOCUMENTS

DE 44 15 407 A1 11/1995
EP 2642095 A4 * 11/2014 ..... B03C 3/15

(Continued)

*Primary Examiner* — Frank Lawrence
*Assistant Examiner* — Sonji Turner
(74) *Attorney, Agent, or Firm* — Oliff PLC

(57) ABSTRACT

This separator device includes a separation chamber having an inlet and an outlet, an oil recovery chamber coupled to the separation chamber, an emitter electrode, a collector electrode, and an electronic unit connected to the emitter and collector electrodes, for during a charging phase, bringing the emitter electrode to a negative potential, so as to negatively charge oil drops, and bringing said at least one collector electrode to a zero or positive potential, so as to collect negatively charged oil drops. The separator device further includes a pressure-drop generating member in the separation chamber. The oil recovery chamber is coupled to the downstream portion of the separation chamber via a vacuuming port, so that the oil recovery chamber is depressed.

25 Claims, 4 Drawing Sheets

(51) Int. Cl.

| | |
|---|---|
| ***B03C 3/14*** | (2006.01) |
| ***B03C 3/36*** | (2006.01) |
| ***B03C 3/74*** | (2006.01) |
| ***B03C 3/88*** | (2006.01) |
| ***F01M 13/04*** | (2006.01) |

(56) References Cited

U.S. PATENT DOCUMENTS

| | | | | |
|---|---|---|---|---|
| 5,956,946 | A | 9/1999 | Yamada | |
| 7,105,042 | B2 * | 9/2006 | Tumbrink | B03C 3/12 55/385.3 |
| 7,704,300 | B2 * | 4/2010 | Szepessy | B01D 45/14 55/DIG. 18 |
| 2004/0226449 | A1 | 11/2004 | Heckel et al. | |
| 2005/0061152 | A1 | 3/2005 | Liu | |
| 2005/0235829 | A1 | 10/2005 | Tumbrink et al. | |

FOREIGN PATENT DOCUMENTS

| | | | | | |
|---|---|---|---|---|---|
| JP | 03141811 | A | * | 6/1991 | F01M 13/04 |
| JP | 2007198344 | A | * | 8/2007 | B03C 3/06 |
| JP | 2009008096 | A | * | 1/2009 | B03C 3/06 |
| JP | 2013238172 | A | * | 11/2013 | B03C 3/41 |

* cited by examiner

Fig. 3
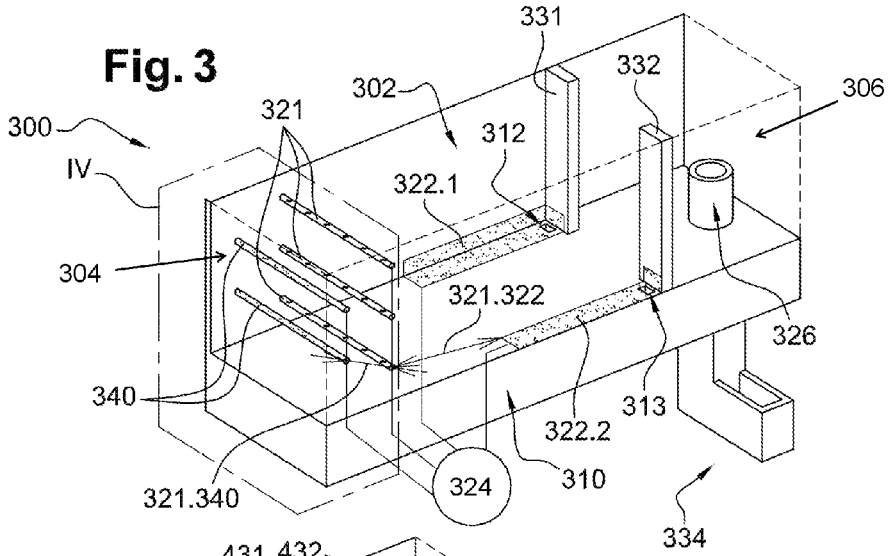
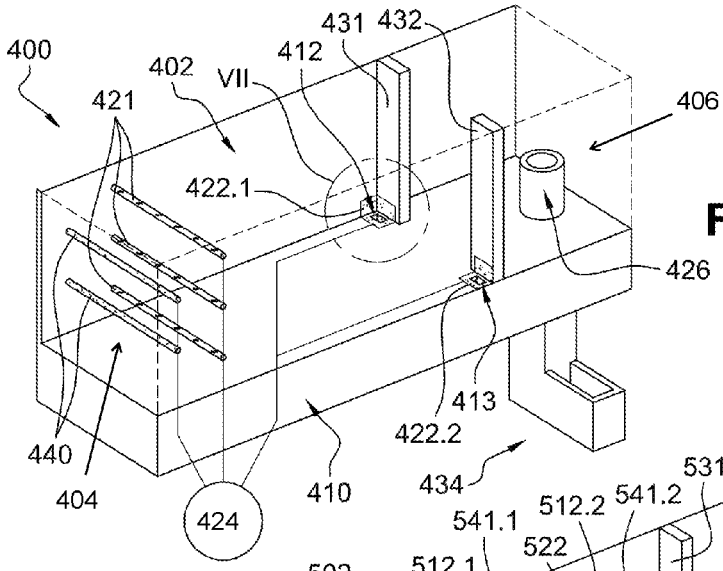
Fig. 6
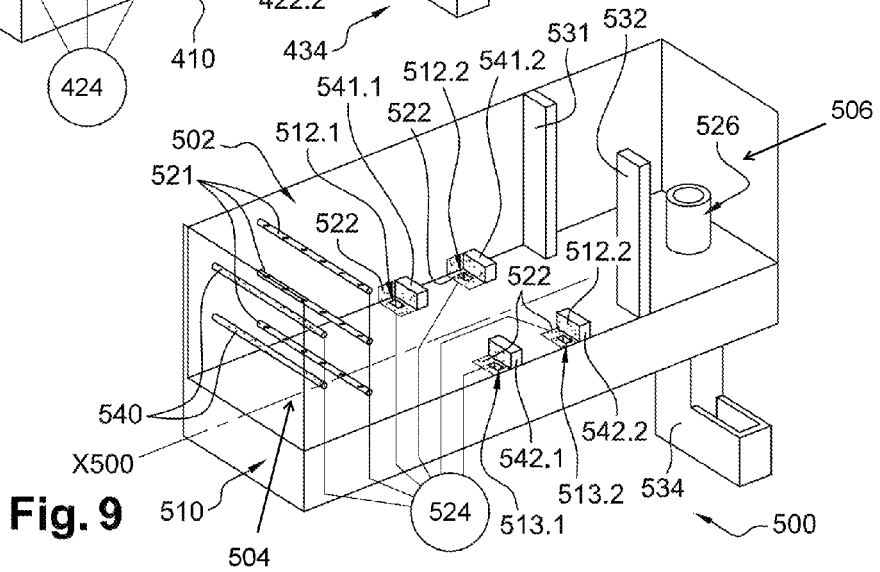
Fig. 9

DEVICE FOR SEPARATING OIL DROPS IN A MIXTURE OF GAS AND OIL AND A SEPARATION METHOD IMPLEMENTING SUCH A SEPARATOR DEVICE

FIELD OF THE INVENTION

The present invention relates to a separator device for separating oil drops from a mixture of gas and oil and from an internal combustion engine. Moreover, the present invention relates to a separation method implementing such a separator device.

The present invention applies in particular to the field of separating oil and gas from a mixture from an internal combustion engine of a motor vehicle, of Diesel or petrol type. By motor vehicle is meant in particular private vehicles, commercial vehicles or industrial vehicles for example of truck type.

BACKGROUND OF THE INVENTION

An internal combustion engine in service generates crankcase gases, which form an aerosol mixture comprising oil drops in suspension in a gas. The oil drops originate from the splashing of the connecting rods and crankshaft in the oil contained in the oil tank. The gas originates from the leaks between the cylinders and the pistons; these leaks are sometimes called blow-by gas. Thus, it is necessary to separate the oil from the gas in order to re-inject the oil in the internal combustion engine.

US2008216660A1 describes an electrostatic filter for separating oil drops from a mixture of gas and oil. The electrostatic filter of US2008216660A1 comprises a separation chamber, an oil recovery chamber coupled to the separation chamber for the flowing of oil, an emitter electrode, collector electrode, and an electronic unit supplying the emitter electrode.

However, in the electrostatic filter of US2008216660A1, when the mixture is rich in oil, the oil captured by the collector electrode gathers on the collector electrode without being entirely discharged, thereby inducing a risk of clogging, hence of defect of the electrostatic filter. Furthermore, the oil gathered is hardly discharged on the collector electrode. However, the electrostatic charges gathered risk leading to an electric breakdown in the electrostatic filter, hence disabling the electrostatic filter.

BRIEF SUMMARY OF THE INVENTION

The present invention in particular aims to resolve, all or part, the aforementioned issues, by providing an efficient and compact separator device.

To this aim, one object of the invention is a separator device, for separating oil drops from a mixture comprising gas and oil drops and originating from an internal combustion engine, the separator device comprising at least:

- a separation chamber having i) an inlet configured for the entry of the mixture into the separation chamber, and ii) an outlet arranged for the exit of gases out of the separation chamber,
- an oil recovery chamber coupled to the separation chamber by means of at least one bleed port, so that liquid oil may flow from the separation chamber to the oil recovery chamber through said at least one bleed port,
- at least one emitter electrode extending at least partially in the separation chamber,

- at least one collector electrode extending at least partially in the separation chamber, and
- an electronic unit connected to said at least one emitter electrode and to said at least collector electrode, the electronic unit being configured for, at least during a charging phases:
  - bringing said at least one emitter electrode to a negative potential, in such a manner that at least one emitter electrode generates at least an electric field suitable for negatively charging oil drops, and
  - bringing said at least one collector electrode to zero or a positive potential, so that said at least one collector electrode collects negatively-charged oil drops, the separator device being characterized in that it further comprises at least one pressure-drop generating member disposed in the separation chamber so as to delimit therein an upstream portion and a downstream portion, the pressure-drop generating member being configured for generating pressure drops between the upstream portion and the downstream portion when the gas flows between the inlet and the outlet, and in that the oil recovery chamber is coupled to the downstream portion by means of at least one vacuuming port, in such a manner that the pressure in the oil recovery chamber is lower than the pressure in the upstream portion.

As the pressure in the oil recovery chamber is lower than the pressure in the upstream portion, part of the gas is suctioned by the bleed port or each bleed port, thus contributing in making the oil flow through the bleed port or each bleed port and towards the oil recovery chamber.

Thus, such a separator device allows an efficient discharge of the oil separated from the mixture, as it allows maximizing the discharge output flow rate of the oil separated from the mixture, while minimizing the bulk thereof. In fact, the oil recovery chamber and each bleed port suction a large output flow rate of oil. Due to this oil suction, the risks of clogging of each collector electrode are reduced, so that the risk of electric breakdown is reduced, even avoided, since each collector electrode gathers less oil hence less static charges.

On a motor vehicle, of Diesel or petrol type, a separator device in accordance with the invention may for example be integrated in the cylinder head cover or form a component independent from the cylinder head cover.

In the present application, the term "couple" and its derivates designate in particular the placing in communication of the fluid, gas and/or liquid, between at least two areas.

In the present application the term "connect" and its derivates relate in particular to an electrically conducting connection between at least two components.

In the present application, the terms "upstream" and "downstream" refer in the general sense of gas flow between the inlet and the outlet. The upstream portion extends from the inlet to said at least one pressure-drop generating member. The downstream portion extends from said at least one pressure-drop generating member to the outlet.

According to a variant of the invention, the pressure-drop generating member is configured in order to generate a pressure difference between 5 Pa and 200 Pa between the oil recovery chamber and the upstream portion.

According to an embodiment of the invention, said at least one emitter electrode and said at least one collector electrode are composed at least partially of electrically conducting materials, and said at least one emitter electrode and said at least one collector electrode each have a surface roughness of which the arithmetic mean difference Ra ranges between 0.1 μm et 100 μm.

Thus, such emitter and collector electrodes are relatively smooth, hence hardly wetting, thus promoting spreading the oil drops separated from the mixture on the emitter and collector electrodes, thereby reducing the oil gathered on the emitter and collector electrodes.

According to a variant of the invention, said at least one emitter electrode and said at least one collector electrode are composed of plastic materials coated with electrically conducting materials. Alternatively to this variant, said at least one emitter electrode and said at least one collector electrode may be totally composed of electrically conducting materials, for example of metallic materials.

According to a variant of the invention, the electronic unit is configured for, at least during a charging phase, to bring said at least one emitter electrode to a substantially constant negative potential. Thus, such an electronic unit allows generating an electrostatic field, thus maximizing the charge of the oil drops, thereby the yield of the oil deposit on each collector electrode, hence the separation efficiency of the separator device.

According to an embodiment of the invention, said at least one emitter electrode extends near the inlet.

Thus, the emitter electrode or each emitter electrode may negatively charge oil drops as soon as the mixture enters the separation chamber, thus allowing to minimize the bulk of the separator device.

According to a variant of the invention, a distance separating the inlet and said at least one emitter electrode is between 0% and 30% of the distance separating the inlet and the outlet. The distance separating the inlet and the outlet corresponds to the length of the separation chamber.

According to an embodiment of the invention, said at least one emitter electrode comprises at least one threadlike portion.

Thus, such a threadlike portion allows increasing the intensity of the electric field for a given electrical voltage, hence the yield of the deposit of oil on the collector electrode. Indeed, a threadlike portion produces an important lightning rod effect, as the section thereof has small dimensions.

According to an embodiment of the invention, at least one threadlike portion extends along a direction transversal to a flow direction of the mixture between the inlet and the outlet.

Thus, such a threadlike portion transversal to the flow of the mixture allows generating an electric field in an important part of the flow section of the separation chamber. Hence, such a threadlike transverse portion allows charging numerous oil drops contained in the mixture.

According to a variant of the invention, said at least one threadlike portion extends globally along at least one direction perpendicular to a flow direction of the mixture between the inlet and the outlet.

According to a variant of the invention, the threadlike portion is rectilinear. Thus, such a rectilinear filiform portion is simple to set up in the separation chamber.

Alternatively to this variant, the threadlike portion may be curvilinear. Thus, such a curvilinear threadlike portion may be suitable for the geometry of the separation chamber.

According to a variant of the invention, each threadlike portion has a shape generally in the form of a circle, of which the diameter is less than 1 mm. Thus, such a threadlike portion produces an important lightning rod effect, hence a strong electric field.

According to a variant of the invention, at least one threadlike portion is formed by a wire. According to another variant of the invention, at least one threadlike portion is formed by a needle.

According to an embodiment of the invention, the separator device comprises at least two emitter electrodes, the threadlike portions being arranged substantially parallel.

Thus, several emitter electrodes allow producing several electric fields, hence maximize the charge of the oil drops and the number of charged oil drops.

According to an embodiment of the invention, the separator device further comprises at least one auxiliary electrode connected to the electronic unit, the electronic unit being configured for, at least during a charging phase, bringing said at least one auxiliary electrode to a zero or positive potential.

Said at least one auxiliary electrode being arranged closer to said emitter electrode than said at least collector electrode, such that an electric field established between said at least one emitter electrode and said at least one auxiliary electrode is stronger than an electric field established between said at least one emitter electrode and said at least one collector electrode.

Thus, each auxiliary electrode allows maximizing the electric field crossed by the oil drops. Indeed, each auxiliary electrode may be placed near the inlet and an emitter electrode, whereas each collector electrode must rather be placed near bleed ports in such a manner as to gather the oil near its outlet towards the oil recovery chamber.

According to an embodiment of the invention, the separator device comprises at least two auxiliary electrodes formed by auxiliary threadlike portions and arranged substantially parallel between them and the emitter electrodes, the auxiliary electrodes and the emitter electrodes being arranged in a staggered arrangement.

In other words, each auxiliary electrode being located facing an interval delimited by two consecutive emitter electrodes.

Thus, such a staggered arrangement allows increasing the pathway length of the oil drops in the electric field, hence their charging period and their charge. In fact, each electric field generated between an emitter electrode and an auxiliary electrode extends along an oblique direction with respect to the flow direction of the mixture.

According to a variant of the invention, the distance between a neighbouring auxiliary electrode and emitter electrode is between 10% and 30% of the distance between this emitter electrode and the nearest collector electrode. For example, if the distance between an auxiliary electrode and a neighbouring emitter electrode is of 5 mm, then the distance between an emitter electrode and the nearest collector electrode may be between 15 mm and 50 mm.

Thus, such a distance allows generating stronger electric fields between emitter electrodes and auxiliary electrodes than between emitter and collector electrodes, thus increasing the number of oil drops charged and the charge of each oil drop before the oil drops arrive near each collector electrode According to an embodiment of the invention, said at least one auxiliary electrode is arranged upstream of said at least one emitter electrode.

Thus, such an arrangement allows maximizing the collection of oil drops by a collector electrode Indeed, the electric field generated between a downstream emitter electrode and an upstream auxiliary electrode induces on each charged oil drop an electrostatic force opposite the air force. Hence, this electric field slows down each oil drop, thus facilitating the capture thereof by a collector electrode. Furthermore, the air force tends to move each charged oil drop away from the auxiliary electrode (of opposite or zero charge), thus limiting or preventing the gathering of oil on the auxiliary electrode.

According to an embodiment of the invention, a flow section of said at least one vacuuming port is greater than a flow section of said at least one bleed port.

Thus, such a vacuuming port guarantees a sufficient pressure difference between the oil recovery chamber and the separation chamber. Hence, such a vacuuming port guarantees the flow of oil through each bleed port.

According to a variant of the invention, the size ratio of i) a flow section of said at least one vacuuming port and ii) a flow section of said at least one bleed port is larger than or equal to 2. Thus, such a vacuuming port maximizes the pressure difference between the oil recovery chamber and the separation chamber.

According to an embodiment of the invention, said at least one bleed port is located in a lower region of the upstream portion, for example on the bottom of the upstream portion.

Thus, such a location allows a flow of oil by gravitation through the bleed port, in addition to the suction due to the vacuuming port.

In the present application, the terms "lower" and "higher" refer to the altitude of an element when the separator device is in service position.

According to an embodiment of the invention, said at least one bleed port is located near or in a respective lateral wall of the upstream portion.

Thus, such a location allows increasing the output flow rate of oil flowing through the bleed port. Indeed, the gas velocity, hence the air force exerted on each oil drop, is minimum near the walls (calm area), thus minimizing the risk that an oil drop be carried by the gas out from the bleed port.

According to an embodiment of the invention, the separator device comprises at least two bleed ports disposed respectively on two opposite borders of the upstream portion, for example respectively near the two opposite lateral walls of the upstream portion.

Thus, several bleed ports allow increasing the output flow rate of oil flowing towards the oil recovery chamber.

In the present application, the terms "border" and "lateral" refer to the general direction of gas flow between the inlet and the outlet.

According to a variant of this embodiment, the separator device comprises an even number of bleed ports, the bleed ports being disposed in equal number on each border of the upstream portion. Thus, the profile of gas velocities in the separation chamber is symmetrical, thus allowing flows of oil with equivalent output flow rates through the bleed ports.

For example, the separator device may comprise four bleed ports, two bleed ports being disposed on one border of the upstream portion and two bleed ports being disposed on the other border of the upstream portion.

According to a variant of the invention, the separation chamber has an axis of symmetry, the bleed ports being disposed symmetrically on each border of the axis of symmetry.

According to an embodiment of the invention, said at least one collector electrode extends near said at least one bleed port.

Thus, the oil is deposited on each collector electrode nearest the bleed ports, thereby facilitating the flow of oil towards the oil recovery chamber.

According to a variant of the invention, the distance separating a respective bleed port and corresponding collector electrode represents between 0% and 5% of the distance separating the inlet and the outlet.

According to an embodiment of the invention, the separator device comprises at least two bleed ports and at least two collector electrodes, each collector electrode extending near a respective bleed port.

Thus, several collector electrodes and several bleed ports allow increasing the output flow rate of oil flowing towards the oil recovery chamber.

According to an embodiment of the invention, said at least one collector electrode comprises an electrically conducting film, said at least one electrically conducting film covering at least partially a lower surface of the upstream portion.

Thus, such an electrically conducting film allows forming an efficient and light collector electrode.

According to a variant of the invention, each of said at least two collector electrodes is formed by an electrically conducting strip covering a respective portion of the lower surface (or bottom) of the upstream portion of the separation chamber, a portion of each electrically conducting strip being arranged near or around a respective bleed port.

According to an alternative to the previous embodiment, the separator device comprises a single collector electrode. For example, the single collector electrode may totally or partially cover the lower surface (or bottom) of the upstream portion of the separation chamber. Thus, numerous oil drops may be charged and collected.

According to an embodiment of the invention, said at least one collector electrode comprises:

- a peripheral electrically conducting film extending around said at least one bleed port, and
- at least one adjacent electrically conducting film arranged so as to prolong the peripheral electrically conducting film and to be extended substantially vertically when the separator device is in service position.

Thus, such peripheral and adjacent electrically conducting films allow increasing the output flow rate of oil flowing towards the oil recovery chamber. In fact, the peripheral film allows collecting oil from around the bleed port, whereas the adjacent film allows gravitation to lead the oil towards the bleed port.

According to an embodiment of the invention, said at least one bleed port has at least a sharp border comprising an edge having a bend radius lower than 0.2 mm, and said at least one collector electrode covers said sharp border.

Thus, such a sharp border produces a lightning rod effect, thus allowing generating relatively strong electric fields between the charged oil drops and the collector electrode covering the sharp border.

According to a variant of the invention, a collector electrode extends to the inside of a respective bleed port. In other words, this collector electrode covers each border by at least one edge of this bleed port.

According to an embodiment of the invention, said at least one sharp border comprises two edges having a bend radius lower than 0.2 mm, the two edges being joined by a rounded fillet, for example with a section in the form of an arc of circle, the rounded fillet having a radius higher than 0.5 mm, preferably higher than 1 mm, said at least one collector electrode covers the sharp borders and the rounded fillet.

Thus, such sharp borders produce lightning rod or spike effects, thus allowing generating relatively strong electric fields between the charged oil drops and the collector electrode covering the sharp borders. Likewise, the rounded fillet produces an inverse lightning rod effect, thus allowing generating relatively strong electric fields between the charged oil drops and the collector electrode covering the rounded fillet.

According to an embodiment of the invention, said at least one pressure-drop generating member is disposed near a respective bleed port.

Thus, such a positioning allows the pressure-drop generating member to highly decrease the gas velocities near each bleed port. Hence, this positioning reduces the risks of leading oil drops out from each bleed port. In addition, the pressure-drop generating member delimits a separation area near each bleed port, thus promoting the capture of the oil drops by a collector electrode.

According to a variant of the invention, the distance separating said at least one pressure-drop generating member and a respective bleed port represents between 0% and 20% of the distance separating the inlet and the outlet.

According to a variant of the invention, said at least one pressure-drop generating member is contiguous with a respective bleed port.

According to a variant of the invention, said at least one pressure-drop generating member is configured for generating singular pressure drops.

According to an embodiment of the invention, said at least one pressure-drop generating member is formed by an obstacle.

Thus, such an obstacle is easy to implant in the separation chamber and it produces pressure drops which hardly vary with the output flow rate of the gas flow.

According to a variant of the invention, said at least one obstacle has a height between 50% and 100% of the height of the upstream portion.

According to a variant of the invention, said at least one pressure-drop generating member obstructs between 5% and 30% of the flow section of the separation chamber.

According to an alternative to the previous embodiment, at least one pressure-drop generating member is formed by an incurved section.

According to another variant to the previous embodiment, at least one pressure-drop generating member is formed by a reducing segment which has a reduced flow section with respect to the inlet.

According to an embodiment of the invention, the separation chamber generally has the shape of a parallelepiped, for example with a rectangular base, and the oil recovery chamber generally has the shape of a parallelepiped, for example with a rectangular base.

Thus, such a separation chamber in the form of a parallelepiped is easy to implant in an engine compartment.

According to an embodiment of the invention, the separation chamber generally has the shape of a cylinder, for example with a circular base, and the oil recovery chamber has generally the shape of a tube disposed around the separation chamber.

Thus, such a separation chamber in the form of a cylinder has a gas flow having a uniform profile of velocities.

According to a variant of this embodiment, the separator device comprises several emitter electrodes formed by threadlike portions arranged substantially parallel with each other and to the axis of the cylinder.

Alternatively to the two previous embodiments, the separation chamber has a generally incurved shape between the inlet and the outlet. In other words, the separation chamber forms an elbow, such that the gas flow lines between the inlet and the outlet are bent.

According to an embodiment of the invention, the separator device further comprises a transfer member coupled to the oil recovery chamber, the transfer member being configured in order to allow a flow of liquid oil towards the internal combustion engine and to prevent a flow of the gas of the internal combustion engine towards the oil recovery chamber.

Thus, such a transfer member allows maintaining the oil recovery chamber in vacuum with respect to the separation chamber, as the transfer member prevents any arrival of gas coming from the internal combustion engine via the transfer member towards the oil recovery chamber.

According to a variant of the invention, the transfer member comprises a siphon and a transfer piping configured for a transfer of oil towards an engine unit. Alternatively, the transfer member comprises a valve and a transfer piping configured for a transfer of oil towards an engine unit.

Furthermore, the object of the present invention is a separation method, for separating oil drops from a mixture comprising gas and oil drops and originating from an internal combustion engine, the separation method comprising the steps of:

- implementing a separator device according to the invention,
- during a charging phase, controlling the electronic unit in such a manner that:
  - said at least one emitter electrode generates at least one electric field suitable for negatively charging oil drops, and
  - said at least one collector electrode collects oil drops charged negatively, and
- allowing the entry of the mixture into the separation chamber.

Thus, such a separation method allows an efficient discharge of the oil separated from the mixture.

The aforementioned embodiments and variants may be taken alone or according to any technically possible combination.

BRIEF DESCRIPTION OF THE SEVERAL VIEWS OF THE DRAWINGS

The present invention will be well understood and its advantages will also appear in light of the following description, given only by way of non-limiting example and made with reference to the accompanying drawings, in which:

FIG. 3 is a schematic perspective view of a separator device in accordance with a third embodiment of the invention;

FIG. 5 schematically shows lines of electric fields between the emitter electrodes and the auxiliary electrodes belonging to the separator device of FIG. 3;

FIG. 6 is a schematic perspective view of a separator device in accordance with a fourth embodiment of the invention;

FIG. 9 is a schematic perspective view of a separator device in accordance with a fifth embodiment of the invention;

DETAILED DESCRIPTION OF THE INVENTION

Figure 1:
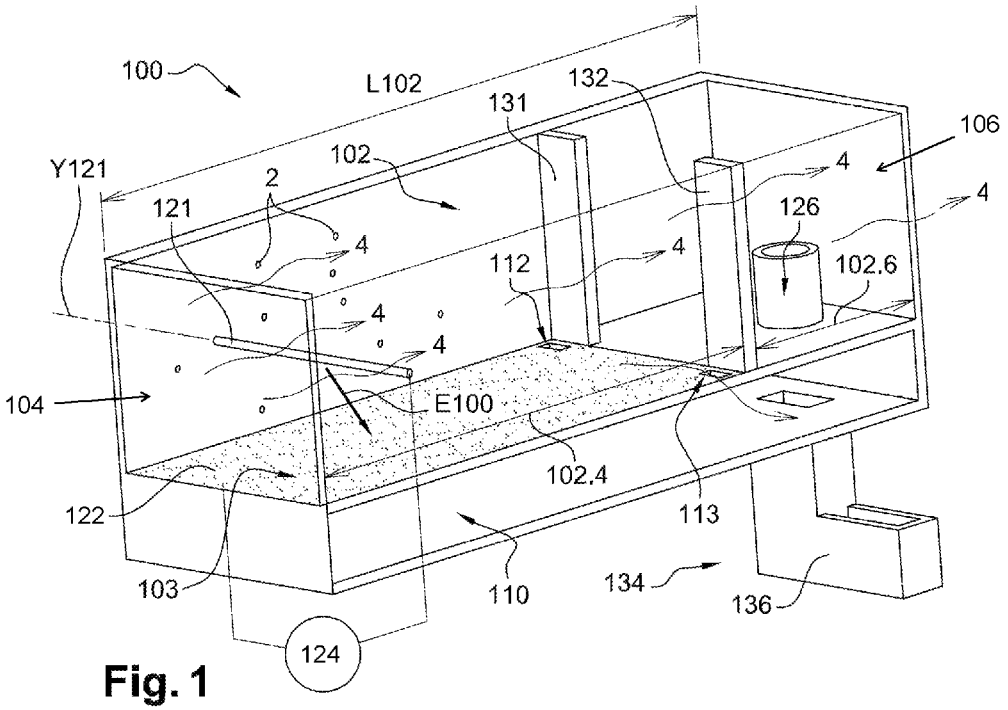
FIG. 1 is a schematic perspective view of a separator device in accordance with a first embodiment of the invention.

FIG. 1 illustrates a separator device 100 for separating oil drops 2 from a mixture comprising oil drops 2 and gas, symbolized by flow lines 4. This mixture originates from an internal combustion engine which is not represented. The oil drops 2 may be generally of spherical form with a diameter between 0.1 μm and 100 μm.

The separator device 100 comprises a separation chamber 102. The separation chamber 102 generally has the form of a parallelepiped with a rectangular base.

The separation chamber 102 has an inlet 104, which is configured for the entry of the mixture into the separation chamber 102. Moreover, the separation chamber 102 has an outlet 106, which is arranged for the exit of the gas 4 out of the separation chamber 102. When the separator device 100 is in service, the mixture enters into the separation chamber 102 via the inlet 104 and the gas 4 exits out of the separation chamber 102 by the outlet 106.

Furthermore, the separator device 100 comprises an oil recovery chamber 110. The oil recovery chamber 110 generally has the form of a parallelepiped with a rectangular base.

The oil recovery chamber 110 is coupled to the separation chamber 102 by means of two bleed ports 112 and 113. When the separator device 100 is in service, the liquid oil flows from the separation chamber 102 to the oil recovery chamber 110 through the bleed ports 112 and 113.

In addition, the separator device 100 comprises an emitter electrode 121 and a collector electrode 122. The emitter electrode 121 entirely extends into the separation chamber 102. Likewise, the collector electrode 122 entirely extends into the separation chamber 102.

The emitter electrode 121 and the collector electrode 122 are composed of plastic materials coated with electrically conducting materials, for example a metal alloy. The emitter electrode 121 and the collector electrode 122 each have a surface roughness of which the arithmetic mean difference Ra is equal to about 50 μm.

The emitter electrode 121 extends near the inlet 104. The distance separating the inlet 104 and the emitter electrode 121 is about equal to 15% of the distance separating the inlet 104 and the outlet 106. The distance separating the inlet 104 and the outlet 106 corresponds to the length L102 of the separation chamber 102.

The emitter electrode 121 comprises a threadlike portion which is formed by a rectilinear wire. The emitter electrode 121 extends generally along a direction Y121 perpendicular to a flow direction of the mixture between the inlet 104 and the outlet 106.

The wire forming the emitter electrode 121 has a profile in the form of a circle, of which the diameter is equal to about 0.8 mm. Thus, such a threadlike portion produces an important lightning rod effect, hence a strong electric field.

The collector electrode 122 extends around the bleed port 112 and around the bleed port 113. The distance separating a respective bleed port 112 or 113 and the collector electrode 122 represents 0% of the distance separating the inlet 104 and the outlet 106.

The collector electrode 122 comprises an electrically conducting film entirely covering the lower surface 103 of the upstream portion 102.4.

The separator device 100 further comprises an electronic unit 124 which is connected to the emitter electrode 121 and to the collector electrode 122. The electronic unit 124 is configured for, during a charging phase:

- bringing the emitter electrode 121 to a negative potential, such that the emitter electrode 121 generated at least one electric field E100 suitable for negatively charging oil drops 2; the negative potential of the emitter electrode 121 may be comprised for example between −5 kV and −20 kV, and
- bringing the collector electrode 122 to a zero or a positive potential, such that the collector electrode 122 collects negatively charged oil drops 2 in the electric field E100; the zero or positive potential of the collector electrode 122 may be between for example 0 V and 12 V.

The electronic unit 124 is configured for, during a charging phase, bringing the emitter electrode 121 to a substantially constant negative potential, hence for generating an electrostatic field.

The separator device 100 further comprises two pressure-drop generating members 131 and 132. The pressure-drop generating members 131 and 132 are disposed in the separation chamber 102 so as to delimit an upstream portion 102.4 and a downstream portion 102.6 therein.

The upstream portion 102.4 extends from the inlet 104 to the pressure-drop generating members 131 and 132. The downstream portion 102.6 extends from the pressure-drop generating members 131 and 132 to the outlet 106.

The pressure-drop generating members 131 and 132 are configured to generate pressure drops between the upstream portion 102.4 and the downstream portion 102.6 when the gas 4 flows between the inlet 104 and the outlet 106. Each pressure-drop generating member 131 or 132 is here formed by an obstacle. Each pressure-drop generating member 131 or 132 hence produces singular pressure drops.

Each pressure-drop generating member 131 or 132 here obstructs around 20% of the flow section of the separation chamber 102. Thus, the pressure-drop generating members 131 and 132 allow generating a pressure difference nearly equal to 100 Pa between the upstream portion 102.4 and the oil recovery chamber 110.

The pressure-drop generating member 131 is disposed near the bleed port 112. The pressure-drop generating member 132 is disposed near the bleed port 113. Each pressure-drop generating member 131 or 132 has a height equal to 100% of the height of the upstream portion 102.4.

Each pressure-drop generating member 131 or 132 is contiguous with the respective bleed port 112 or 113. Hence the distance separating a pressure-drop generating member 131 or 132 of the respective bleed port 112 or 113 here represents 0% of the distance separating the inlet 104 and the outlet 106.

The bleed ports 112 are located in a lower region of the upstream portion 102.4. In the example of FIG. 1, the bleed ports 112 are located on the bottom of the upstream portion 102.4. The oil recovery chamber 110 is disposed under the separation chamber 102. Hence, the oil may flow through the bleed ports 112 by gravitation, in addition to the suction due to the aforementioned pressure difference.

Furthermore, the bleed ports 112 and 113 are disposed respectively on two opposite borders of the upstream portion 102.4. In the example of FIG. 1, the bleed port 112 is located near a lateral wall of the upstream portion 102.4 and the bleed port 113 is located near the opposite lateral wall.

The oil recovery chamber 110 is coupled to the downstream portion 102.6 by means of a vacuuming port 126, such that the pressure in the oil recovery chamber 110 is lower than the pressure in the upstream portion 102.4. The vacuuming port 126 is formed at a tube section with a circular section.

A flow section of the vacuuming port 126 is greater than a flow section of each bleed port 112 or 113. In the example of FIG. 1, the size ratio between the dimension of a flow section of the vacuuming port 126 and the dimension of a flow section of each bleed port 112 or 113, is nearly equal to 10.

The separator device 100 further comprises a transfer member 134, which is coupled to the oil recovery chamber 110. The transfer member 134 is configured for allowing a flow of the liquid oil towards the internal combustion engine and for preventing the gas 4 from flowing.

The transfer member 134 comprises a siphon 136 and a non represented transfer piping. The transfer piping is configured for an oil transfer towards a non represented engine unit.

When the separator device 100 is in service, the electronic unit 124 may bring the emitter electrode 121 to a negative potential (−20 kV). The emitter electrode 121 emits negative electric charges when it is polarized (brought to a negative potential).

During a charging phase, the electronic unit 124 may bring the collector electrode 122 to a zero potential (0 V). The collector electrode 122 attracts the negatively charged oil drops, as electric fields are set up between the collector electrode 122 and each of the charged oil drops. These electric fields exert electrostatic forces on each charged oil drop.

Then, the oil drops are deposited on the collector electrode 122, where the gas flow passing by the bleed ports 112 and 113 suctions the liquid oil towards the oil recovery chamber 110. Finally, the liquid oil leaves the oil recovery chamber 110 by the transfer member 134.

Figure 2:
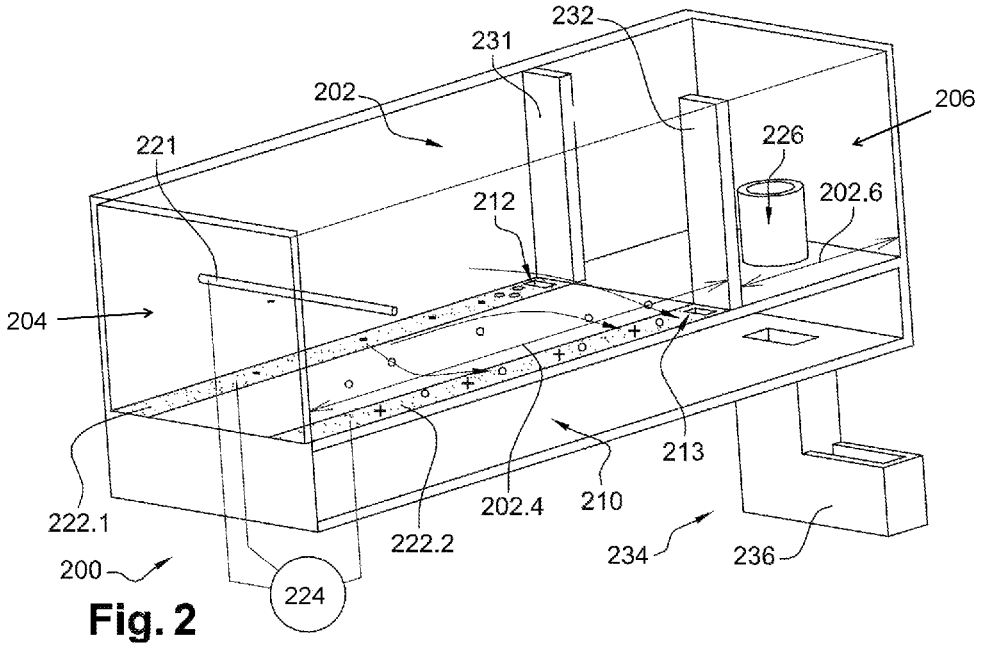
FIG. 2 is a schematic perspective view of a separator device in accordance with a second embodiment of the invention.

FIG. 2 illustrates a separator device 200 in accordance with a second embodiment of the invention. In as far as the separator device 200 is similar to the separator device 100, the description of the separator device 100 given in relation to FIG. 1 may be transposed to the separator device 200, except for the hereafter mentioned noticeable differences.

A component of the separator device 200 identical or corresponding, by the structure or function thereof, to a component of the separator device 100 bears the same numerical reference increased by one hundred. It is thus defined a separation chamber 202, an inlet 204, an outlet 206, an oil recovery chamber 210, two bleed ports 212 and 213, an emitter electrode 221, an electronic unit 224, a vacuuming port 226 and pressure-drop generating members 231 and 232 delimiting an upstream portion 202.4 and a downstream portion 202.6 of the separation chamber 202, a transfer member 234 with a siphon 236.

The separator device 200 differs from the separator device 100, as it comprises two collector electrodes 222.1 and 222.2, whereas the separator device 100 comprises a single collector electrode 122.

Each of the collector electrodes 222.1 and 222.2 is formed by an electrically conducting strip covering a respective portion of the lower surface of the upstream portion 202.4. A portion of each electrically conducting strip is arranged around a respective bleed port 212 or 213. Each of the collector electrodes 222.1 and 222.2 extends parallel to the direction connecting the inlet 204 and the outlet 206.

When the separator device 200 is in service, the electronic unit 224 may bring the collector electrodes 222.1 and 222.2 to different potentials. During a charging phase, the electronic unit 224 may bring the electronic electrodes 222.1 and 222.2 to a zero potential.

Then, during a discharging phase, the electronic unit 224 may bring the collector electrodes 222.1 and 222.2 to a negative potential, for example −10 kV. The charging phase may last longer than the discharging phase. During the discharging phase, the oil drops gathered on the collector electrodes 222.1 and 222.2 are discharged and are pushed by the collector electrodes 222.1 and 222.2, so well that they flow easily through the bleed ports 212 and 213.

In addition, the electronic unit 224 may operate in a differed manner the charging and discharging phases of the collector electrodes 222.1 and 222.2, thus allowing to continue charging the oil drops with the collector electrode 222.1 at a zero potential, whereas oil drops are discharged when the collector electrode 222.2 is at a negative potential. Thus, the electronic unit 224 allows permanently charging oil drops while efficiently discharging the oil.

Figure 4:
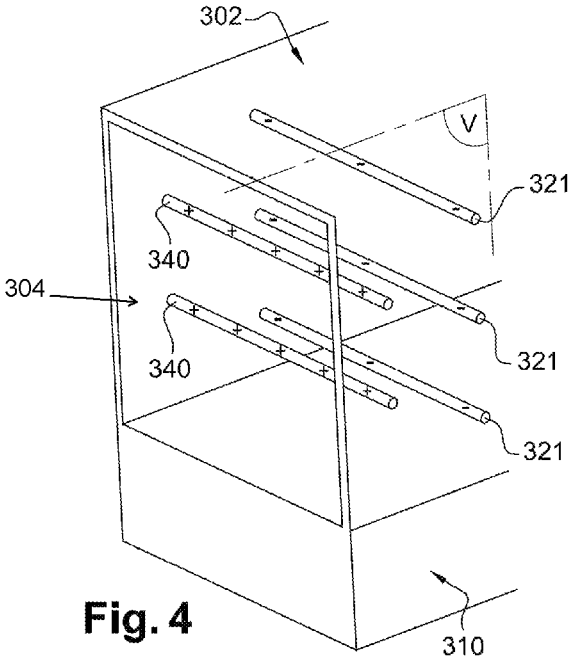
FIG. 4 is a view on a larger scale of the detail IV on FIG. 3.
Figure 5:
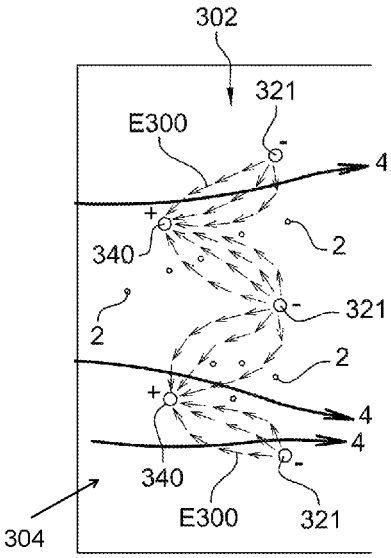
FIG. 5 is a section according to plane V of FIG. 4.

FIGS. 3, 4 and 5 illustrate a separator device 300 in accordance with a third embodiment of the invention. In as far as the separator device 300 is similar to the separator device 200, the description of the separator device 200 given in relation to FIG. 2 may be transposed to the separator device 300, except for the hereafter mentioned noticeable differences.

A component of the separator device 300 identical or corresponding, by the structure or function thereof, to a component of the separator device 200 bears the same numerical reference increased by one hundred. It is thus defined a separation chamber 302, an inlet 304, an outlet 306, an oil recovery chamber 310, two bleed ports 312 and 313, two collector electrodes 322.1 and 322.2, an electronic unit 324, a vacuuming port 326 and pressure-drop generating members 331 and 332, as well as a transfer member 334.

The separator device 300 differs from the separator device 200, as it comprises three emitter electrodes 321, whereas the separator device 200 comprises one single emitter electrode 221. The emitter electrodes 321 are formed by threadlike portions arranged substantially parallel to each other.

In addition, the separator device 300 differs from the separator device 200, as it comprises two auxiliary electrodes 340. The auxiliary electrodes 340 are connected to the electronic unit 324. The electronic unit 324 is configured so as to bring the auxiliary electrodes 340 to a zero potential, during a charging phase.

The auxiliary electrodes 340 are arranged closer to the emitter electrodes than the collector electrodes 322.1 and 322.2, so that an electric field E300 established between the emitter electrodes and the auxiliary electrodes 340 is stronger than an electric field established between the emitter electrodes 321 and the collector electrodes 322.1 and 322.2.

The auxiliary electrodes 340 are formed by auxiliary threadlike portions which are arranged substantially parallel to each other and to the emitter electrodes 321. The auxiliary electrodes 340 are arranged upstream of the emitter electrodes 321.

As shown specifically in FIGS. 4 and 5, the auxiliary electrodes 340 and the emitter electrodes 321 are arranged in a staggered manner. Thus, each auxiliary electrode 340 is located in front of a gap delimited by two consecutive emitter electrodes 321. When in operation, this staggered arrangement allows enlarging the pathway length of the oil drops 2 in the electric field E300 between each emitter electrode 321 and each auxiliary electrode 340. Hence, the oil drops 2 are subjected to a longer charging period, so much so that they are charged more intensely or in a larger number.

As shown in FIG. 3, the distance 321.340 between an auxiliary electrode 340 and a neighbouring emitter electrode 321 is equal to about 10% of the distance 321.322 between this emitter electrode 321 and the closest collector electrode 322.1 or 322.2.

Furthermore, the separator device 300 differs from the separator device 200, as the collector electrodes 322.1 and 322.2 have a three-dimensional geometry, whereas the collector electrodes 222.1 and 222.2 have a planar geometry.

Indeed, each collector electrode 322.1 or 322.2 comprises i) a peripheral electrically conducting film which extends around a respective bleed port 312 or 313, and ii) two adjacent electrically conducting films which are arranged so as to prolong the peripheral electrically conducting film and to extend substantially vertically when the separator device 300 is in the operation position (FIG. 3).

Thus, each collector electrode 322.1 or 322.2 is formed by three strips which are contiguously mounted on intersecting edges and each of which extends over a respective plane. The three strips forming the collector electrode 322.1 respectively conforming to the lower surface of the separation chamber 302, of a planar lateral wall and of the pressure-drop generating member 331.

FIG. 6 illustrates a separator device 400 in accordance with a fourth embodiment of the invention. In as far as the separator device 400 is similar to the separator device 300, the description of the separator device 300, given with reference to FIGS. 3, 4 and 5, may be transposed to the separator device 400, with the exception of the hereafter mentioned noticeable differences.

A component of the separator device 400 that is identical or correspondent, whether by its structure or function, to a component of the separator device 300 bears the same numerical reference increased by 100. Thus, there are defined a separation chamber 402, an inlet 404, an outlet 406, an oil recovery chamber 410, two bleed ports 412 and 413, emitter electrodes 421, an electronic unit 424, a vacuuming port 426, auxiliary electrodes 440 and pressure-drop generating members 431 and 432, as well as a transfer member 434.

As shown in FIG. 6, the separator device 400 differs from the separator device 300, as the two collector electrodes 422.1 and 422.2 are shorter than the two collector electrodes 322.1 and 322.2. The length of each collector electrode 422.1 or 422.2 represents about 15% of the length of each collector electrode 322.1 and 322.2, the lengths being measured parallel to the length of the separation chamber 402 (see L102 in FIG. 1). The length of the separation chamber 402 corresponds to the distance separating the inlet 104 and the outlet 106.

Since the collector electrodes 422.1 and 422.2 are shorter than the collector electrodes 322.1 and 322.2, all other things being equal, the electric fields between the emitter electrodes 421 and auxiliary electrodes 440 are much stronger than those between the emitter electrodes 421 and the collector electrodes 422.1 and 422.2. This allows increasing the number of charged oil drops 2 and the charge of each oil drop 2 before that the oil drops 2 reach the collector electrodes 422.1 and 422.2.

Figure 7:
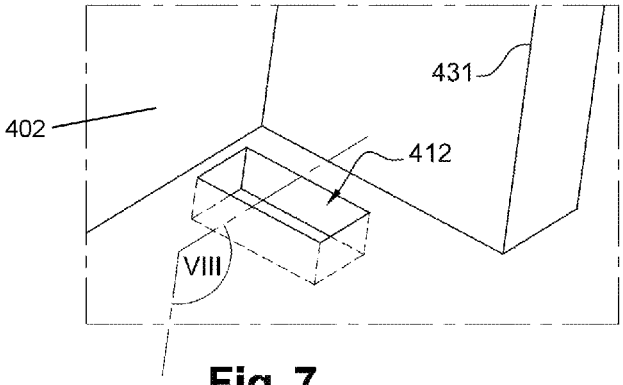
FIG. 7 is a view on a larger scale of the detail VII on FIG. 6.
Figure 8:
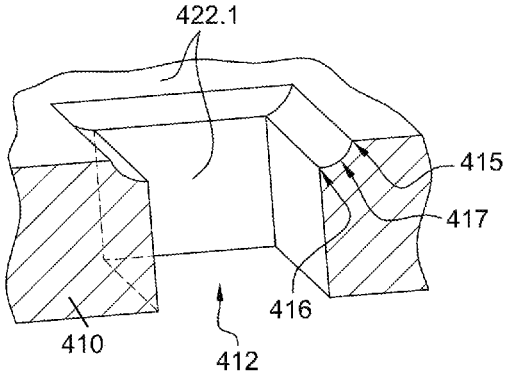
FIG. 8 is a view of part of FIG. 7 on a larger scale and in truncated perspective by plane VIII on FIG. 7.

Furthermore, as shown in FIGS. 7 and 8, the periphery of each bleed port 412 or 413 is formed by four sharp borders each of which comprising two edges 415 and 416.

Each of the edges 415 and 416 has a bend radius equal to about 0.1 mm.

In addition, as shown in FIG. 8, each collector electrode 422.1 or 422.2 extends to the inside of a respective bleed port 412 or 413. Hence, a respective collector electrode 422.1 or 422.2 covers the sharp borders forming the periphery of each bleed port 412 or 413.

Thus, the edges 415 and 416 produce a spike effect, thereby allowing generating relatively strong electric fields between the charged oil drops 2 and the respective collector electrode 422.1 or 422.2.

The edges 415 and 416 are joined by a rounded fillet 417 with a circular-arc shaped section. Here, the rounded fillet 417 has a radius equal to about 1 mm. Each collector electrode 422.1 or 422.2 covers the sharp borders and the rounded fillet 417. Thus, the rounded fillet 417 produces a reversed lightning rod effect, thereby allowing generating relatively strong electric fields between the charged oil drops 2 and the collector electrode 422.1 covering the rounded fillet 417.

FIG. 9 illustrates a separator device 500 in accordance with a fifth embodiment of the invention. In as far as the separator device 500 is similar to the separator device 400, the description of the separator device 400, given hereinbefore with reference to FIG. 6, may be transposed to the separator device 500, with the exception of the hereafter mentioned noticeable differences.

A component of the separator device 500 that is identical or correspondent, whether by its structure or function, to a component of the separator device 400 bears the same numerical reference increased by 100. Thus, there are defined a separation chamber 502, an inlet 504, an outlet 506, an oil recovery chamber 510, emitter electrodes 521, an electronic unit 524, a vacuuming port 526, auxiliary electrodes 540 and pressure-drop generating members 531 and 532, as well as a transfer member 534.

The separator device 500 differs from the separator device 400, as the separator device 500 has four bleed ports 512.1, 512.2, 513.1 and 513.2; whereas the separator device 400 has two bleed ports 412 and 413.

In a similar manner, the separator device 500 differs from the separator device 400, as the separator device 500 comprises four collector electrodes 522; whereas the separator device 400 comprises two collector electrodes 422.1 and 422.2.

Two bleed ports 512.1 and 512.2 are disposed on one side of the upstream portion and two bleed ports 513.1 and 513.2 are disposed on the other side of the upstream portion.

Since the collector electrodes 522 extend around the bleed ports 512.1, 512.2, 513.1 and 513.2, two collector electrodes 522 are disposed on one side of the upstream portion and two collector electrodes 522 are disposed on the other side of the upstream portion.

Like the separator device 400, the separator device 500 comprises an even number of bleed ports and the bleed ports are disposed, in an equal number, on each side of the upstream portion.

Furthermore, in the example of FIG. 9, the separation chamber 502 has an axis of symmetry X500. The bleed ports 512.1, 512.2, 513.1 and 513.2 are disposed symmetrically on each side of the axis of symmetry X500.

In addition, the separator device 500 differs from the separator device 400, as the separator device 500 comprises six pressure-drop generating members, whereas the separator device 400 comprises two pressure-drop generating members 431 and 432. Indeed, the separator device 500 comprises: two primary pressure-drop generating members 531 and 532, which are identical to the two pressure-drop generating members 431 and 432, in addition to four secondary pressure-drop generating members 541.1, 541.2, 542.1 and 542.2.

The secondary pressure-drop generating members 541.1, 541.2, 542.1 and 542.2 are respectively disposed around the bleed ports 512.1, 512.2, 513.1 and 513.2. Each of the four secondary pressure-drop generating members 541.1, 541.2, 542.1 and 542.2 allows reducing the gas velocities in the vicinity of the bleed ports 512.1, 512.2, 513.1 and 513.2; whereas the two primary pressure-drop generating members 531 and 532 rather allow generating a pressure difference between the upstream portion of the separation chamber 502 and the oil recovery chamber 510.

When the separator device 500 is in operation, the electronic unit 524 can bring the collector electrodes 522 to different potentials.

As described hereinbefore with reference to FIG. 2, the electronic unit 524 can perform the charging and discharging phases of the collector electrodes 522, in a delayed manner. For example, three collector electrodes 522 may be brought to a zero potential (charging phase), whereas the fourth collector electrode 522 is brought to a negative potential (discharging phase) in order to push the charged oil drops toward the corresponding bleed port 512.1, 512.2, 513.1 or 513.2.

Afterwards, the electronic unit 524 proceeds to discharge of the other collector electrodes 522, one at a time. This allows continuing charging the oil drops with three collector electrodes 522, while oil drops are discharged when the fourth collector electrode 522 is at a negative potential. Thus, the electronic unit 524 allows charging oil drops, in permanence, while effectively discharging the oil.

Figure 10:
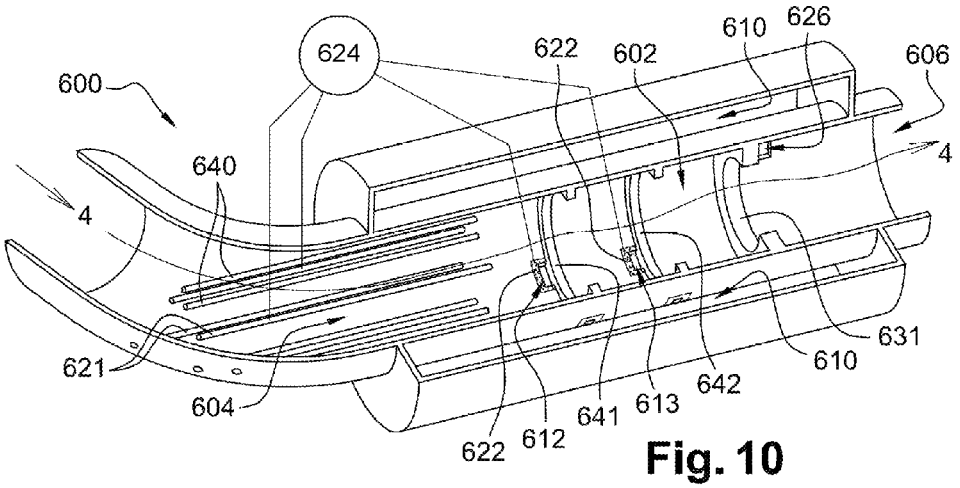
FIG. 10 is a schematic perspective view of a separator device in accordance with a sixth embodiment of the invention.

FIG. 10 illustrates a separator device 600 in accordance with a sixth embodiment of the invention. In as far as the separator device 600 is similar to the separator device 500, the description of the separator device 500, given hereinbefore with reference to FIG. 9, may be transposed to the separator device 600, with the exception of the hereafter mentioned noticeable differences.

A component of the separator device 600 that is identical or correspondent, whether by its structure or function, to a component of the separator device 500 bears the same numerical reference increased by 100. Thus, there are defined a separation chamber 602, an inlet 604, an outlet 606, an oil recovery chamber 610, bleed ports 612, 613 and equivalents, emitter electrodes 621, collector electrodes 622, an electronic unit 624, a vacuuming port 626, auxiliary electrodes 640, primary pressure-drop generating members 631 and secondary pressure-drop generating members 641 and 642. The separator device 600 further comprises a transfer member which is not represented and which is similar, by its function, to the transfer member 534.

The separator device 600 differs from the separator device 500, as the separation chamber 602 has the general shape of a circular-based cylinder, whereas the separation chamber 502 has the general shape of a parallelepiped.

Similarly, the separator device 600 differs from the separator device 500, as the oil recovery chamber 610 has the general shape of a circular tube disposed around the separation chamber 602, whereas the oil recovery chamber 510 has the general shape of a parallelepiped disposed under the separation chamber 502.

Furthermore, the separator device 600 differs from the separator device 500, as the emitter electrodes 621 and the auxiliary electrodes 640, formed by threadlike portions, are arranged substantially parallel to each other and to the axis of the cylinder defining the separation chamber 602, and therefore, substantially parallel to the flow direction of the mixture between the inlet 604 and the outlet 606. On the contrary, the emitter electrodes 521 and the auxiliary electrodes 540 extend perpendicular to the flow direction of the mixture between the inlet 504 and the outlet 506.

Like the separator device 500, the separator device 600 has four bleed ports, two of which are visible in FIG. 10 with the numerical references 612 and 613 two of which are not represented. The two bleed ports are respectively located opposite to the bleed ports 612 and 613 with respect to the axis of the cylinder forming the separation chamber 602.

Furthermore, the mixture is introduced in the separator device 600 via a 90-degree elbow.

Figure 11:
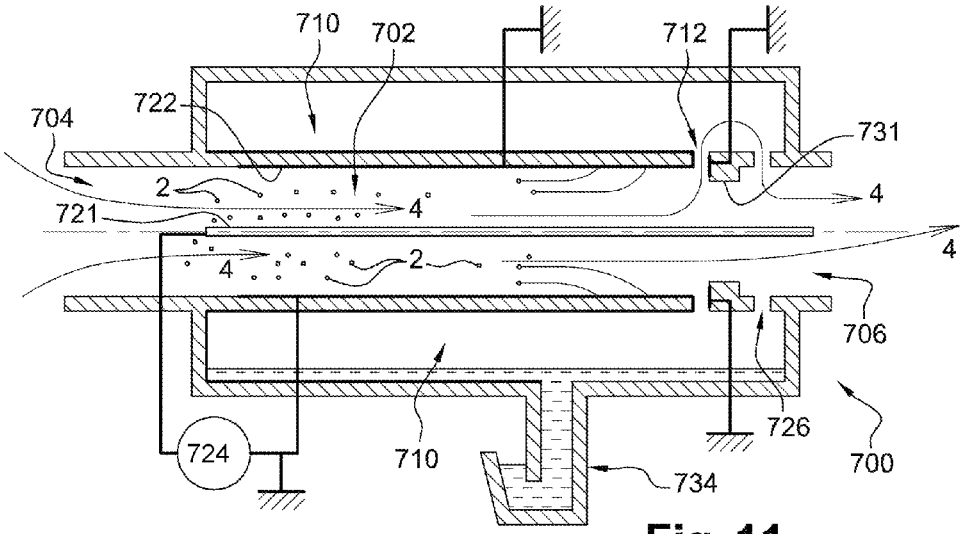
FIG. 11 is a section of a separator device in accordance with a seventh embodiment of the invention.

FIG. 11 illustrates a separator device 700 in accordance with a sixth embodiment of the invention. In as far as the separator device 700 is similar to the separator device 600, the description of the separator device 400, given hereinbefore with reference to FIG. 10, may be transposed to the separator device 700, with the exception of the hereafter mentioned noticeable differences.

A component of the separator device 700 that is identical or correspondent, whether by its structure or function, to a component of the separator device 600 bears the same numerical reference increased by 100. Thus, there are defined a separation chamber 702, an inlet 704, an outlet 706, an oil recovery chamber 710, an electronic unit 724, a vacuuming port 726, a primary pressure-drop generating member 731, as well as a transfer member 734.

As shown in FIG. 11, the separator device 700 differs from the separator device 600,

- as the separator device 700 comprises one single emitter electrode 721 formed by a wire extending along the entire length of the separation chamber 702 and which is collinear with the axis of the cylinder forming the separation chamber 702,
- as the separator device 700 comprises one single collector electrode 722,
- as the separator device 700 comprises one single bleed port 712, which is annular-shaped,
- as the separator device 700 comprises one single pressure-drop generating member 731, which is annular-shaped, and
- as the separator device 700 comprises no auxiliary electrodes 740.

Figure 12:
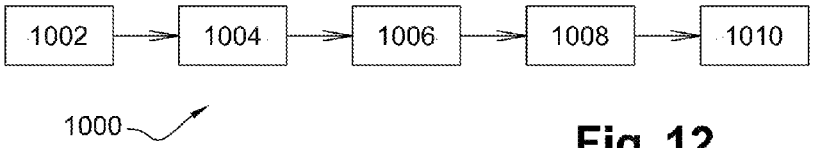
FIG. 12 is a flow chart illustrating a separation method in accordance with the invention.

FIG. 12 illustrates a separation method 1000, for separating oil drops 2 from a mixture comprising gas 4 and oil drops 2 coming from an internal combustion engine. The separation method 1000 comprises the steps of:

- 1002) implementing a separator device according to any of the above-described embodiments,
- 1004) controlling the electronic unit, during a charging phase, so that:
- 1006) the emitter electrode or each emitter electrode generates at least one electric field suitable so as to negatively charge oil drops, and
- 1008) the collector electrode or each collector electrode collects negatively charged oil drops, and
- 1010) allowing the entry of the mixture into the separation chamber.

Of course, the present invention is not limited to the particular embodiments that have been described in the present patent application, nor is it limited to embodiments that are within the reach of the one skilled in the art. Other embodiments may be considered, without departing from the scope of the invention, from any element equivalent to an element indicated in the present patent application.

The invention claimed is:

1. A separator device, for separating oil drops from a mixture comprising gas and oil drops and coming from an internal combustion engine, the separator device comprising at least:

a separation chamber having i) an inlet configured for the entry of the mixture into the separation chamber, and ii) an outlet arranged for the exit of the gas out of the separation chamber, an oil recovery chamber coupled to the separation chamber via at least one bleed port, so that the liquid oil can flow from the separation chamber to the oil recovery chamber through said at least one bleed port, at least one emitter electrode extending at least partially into the separation chamber configured to generate at least one electric field suitable to negatively charge oil drops, at least one collector electrode extending at least partially into the separation chamber configured to collect negatively-charged oil drops, and an electronic unit connected to said at least one emitter electrode and to said at least one collector electrode, in order to:

at least during a charging phase bring said at least one emitter electrode to a negative potential by its connection to the said at least one emitter electrode and, bring said at least one collector electrode to a zero or positive potential by its connection to the said at least one collector electrode, so that said at least one collector electrode collects negatively-charged oil drops, wherein the separator device further comprises at least one pressure-drop generating member disposed in the separation chamber so as to delimit therein an upstream portion and a downstream portion, the pressure-drop generating member being configured so as to generate pressure drops between the upstream portion and the downstream portion when gas flows between the inlet and the outlet, and the oil recovery chamber is coupled to the downstream portion via at least one vacuuming port, so that pressure into the oil recovery chamber is lower than pressure into the upstream portion.

2. The separator device according to claim 1, wherein said at least one emitter electrode and said at least one collector electrode are composed, at least partially, of electrically conducting materials, and wherein said at least one emitter electrode and said at least one collector electrode each have a surface roughness arithmetic mean difference Ra of which ranges between 0.1 μm and 100 μm.

3. The separator device according to claim 1, wherein said at least one emitter electrode extends close to the inlet.

4. The separator device according to claim 1, wherein said at least one emitter electrode comprises at least one threadlike portion.

5. The separator device according to claim 4, wherein at least one threadlike portion extends along a direction transverse to a flow direction of the mixture between the inlet and the outlet.

6. The separator device according to claim 4, comprising at least two emitter electrodes, the threadlike portions being arranged substantially parallel to each other.

7. The separator device according to claim 1, further comprising at least one auxiliary electrode connected to the electronic unit, the electronic unit being configured to bring, at least during a charging phase, said at least one auxiliary electrode to a zero or positive potential by its connection to the said at least one auxiliary electrode, said at least one auxiliary electrode being arranged closer to said at least one emitter electrode than said at least one collector electrode, so that an electric field established between said at least one emitter electrode and said at least one auxiliary electrode is stronger than an electric field established between said at least one emitter electrode and said at least one collector electrode.

8. The separator device according to claim 6, further comprising at least one auxiliary electrode connected to the electronic unit, the electronic unit being configured to bring, at least during a charging phase, said at least one auxiliary electrode to a zero or positive potential by its connection to the said at least one auxiliary electrode, said at least one auxiliary electrode being arranged closer to said at least one emitter electrode than said at least one collector electrode, so that an electric field established between said at least one emitter electrode and said at least one auxiliary electrode is stronger than an electric field established between said at least one emitter electrode and said at least one collector electrode, and wherein the separator device further comprises at least two auxiliary electrodes formed by auxiliary threadlike portions and arranged substantially parallel to each other and to the emitter electrodes, the auxiliary electrodes and the emitter electrodes being arranged in a staggered manner.

9. The separator device according to claim 7, wherein said at least one auxiliary electrode is arranged upstream of said at least one emitter electrode.

10. The separator device according to claim 1, wherein a flow section of said at least one vacuuming port is larger than a flow section of said at least one bleed port.

11. The separator device according to claim 1, wherein said at least one bleed port is located in a lower region of the upstream portion.

12. The separator device according to claim 1, wherein said at least one bleed port is located close to or in a respective lateral wall of the upstream portion.

13. The separator device according to claim 1, comprising at least two bleed ports disposed respectively on two opposite sides of the upstream portion.

14. The separator device according to claim 1, wherein said at least one collector electrode extends close to said at least one bleed port.

15. The separator device according to claim 13, wherein said at least one collector electrode extends close to said at least one bleed port, and wherein the separator device further comprises at least two bleed ports and at least two collector electrodes, each collector electrode extending close to a respective bleed port.

16. The separator device according to claim 1, wherein said at least one collector electrode comprises an electrically conducting film, said at least one electrically conducting film covering, at least partially, a lower surface of the upstream portion.

17. The separator device according to claim 14, wherein said at least one collector electrode comprises an electrically conducting film, said at least one electrically conducting film covering, at least partially, a lower surface of the upstream portion, and wherein said at least one collector electrode comprises:

a peripheral electrically conducting film extending around said at least one bleed port, and at least one adjacent electrically conducting film arranged so as to prolong the peripheral electrically conducting film and to extend substantially vertically when the separator device is in the operative position.

18. The separator device according to claim 1, wherein said at least one bleed port has at least one sharp border comprising an edge having a bend radius smaller than 0.2 mm, and wherein said at least one collector electrode covers said at least one sharp border.

19. The separator device according to claim 18, wherein said at least one sharp border comprises two edges having a bend radius smaller than 0.2 mm, the two edges being joined by a rounded fillet, the rounded fillet having a radius greater than 0.5 mm, said at least one collector electrode covers the sharp borders and the rounded fillet.

20. The separator device according to claim 1, wherein said at least one pressure-drop generating member is disposed close to a respective bleed port.

21. The separator device according to claim 1, wherein said at least one pressure-drop generating member is formed by an obstacle.

22. The separator device according to claim 1, wherein the separation chamber has the general shape of a parallelepiped, and wherein the oil recovery chamber has the general shape of a parallelepiped.

23. The separator device according to claim 1, wherein the separation chamber has the general shape of a cylinder, and wherein the oil recovery chamber has the general shape of a tube disposed around the separation chamber.

24. The separator device according to claim 1, further comprising a transfer member coupled to the oil recovery chamber, the transfer member comprises a transfer piping allowing a flow of the liquid oil towards the internal combustion engine, and a valve or a siphon preventing a flow of the gas from the internal combustion engine towards the oil recovery chamber.

25. A separation method, for separating oil drops from a mixture comprising gas and oil drops coming from an internal combustion engine, the separation method comprising the steps of:

implementing a separator device according to claim 1, controlling the electronic unit, during a charging phase, so that:

said at least one emitter electrode generates at least one electric field suitable for negatively charging oil drops, and said at least one collector electrode collects negatively charged oil drops, and allowing the entry of the mixture into the separation chamber.

* * * * *